US006955563B1

(12) United States Patent
Croan

(10) Patent No.: US 6,955,563 B1
(45) Date of Patent: Oct. 18, 2005

(54) RJ TYPE MODULAR CONNECTOR FOR COAXIAL CABLES

(76) Inventor: Quinn F. Croan, 5533 E. Pinchot Ave., Phoenix, AZ (US) 85018

( * ) Notice: Subject to any disclaimer, the term of this patent is extended or adjusted under 35 U.S.C. 154(b) by 0 days.

(21) Appl. No.: 10/906,192

(22) Filed: Feb. 8, 2005

(51) Int. Cl.[7] ..... H01R 9/05

(52) U.S. Cl. ..... 439/578

(58) Field of Search ..... 439/578, 583

(56) References Cited

U.S. PATENT DOCUMENTS

| | | | | | |
|---|---|---|---|---|---|
| 3,355,698 | A | * | 11/1967 | Keller | 439/421 |
| 3,363,222 | A | * | 1/1968 | Karol | 439/581 |
| 4,400,050 | A | * | 8/1983 | Hayward | 439/585 |
| 4,553,806 | A | * | 11/1985 | Forney, et al. | 439/585 |
| 4,668,043 | A | * | 5/1987 | Saba et al. | 439/585 |
| 4,684,201 | A | * | 8/1987 | Hutter | 439/585 |
| 4,755,152 | A | * | 7/1988 | Elliot et al. | 439/452 |
| 4,806,116 | A | * | 2/1989 | Ackerman | 439/578 |
| 5,073,129 | A | * | 12/1991 | Szegda | 439/585 |
| 6,168,455 | B1 | * | 1/2001 | Hussaini | 439/584 |
| 6,290,538 | B1 | * | 9/2001 | Pocrass | 439/578 |

* cited by examiner

*Primary Examiner*—Briggitte R. Hammond

(57) ABSTRACT

A connector employing a plug assembly and socket assembly for coaxial cables having apertures, conductive elements, mating surfaces and locking mechanisms to maintain the electrical characteristics of the cable joined to the plug and socket, to hold the plug and socket physically in connection with one another, and to establish and maintain the electrical characteristics of the cables through the connector. The plug is configured to attach to a coaxial cable in such a manner that: a) the center conductor of the coaxial cable extends through the plug assembly for engagement with mating conductors in the socket, and b) such that the shield of the cable is physically and electrically engaged by a conductive element extending through the plug which contacts the conductive elements within the socket. These two features establish electrical contact of the shield and center conductor into and through the connector. The connector includes a socket assembly having a receiving aperture formed therein for receiving the plug assembly. The socket assembly is configured to accept a second coaxial cable for electrically contacting the first coaxial cable when the plug is received in the receiving aperture, or, in the modified form, for connecting the first coaxial cable to terminal equipment. The socket assembly includes an outer conductor element that is electrically isolated from inner conductive elements of the socket assembly which provide electrical continuity for the inner conductor of the cables. The outer conductor and inner conductor of the plug assembly and socket assembly are electrically connected when the plug is received in the receiving aperture. The plug and socket assemblies incorporate a snap-fit, locking mechanism to retain the plug and socket assemblies in mechanical and electrical connection with each other.

7 Claims, 10 Drawing Sheets

RJ TYPE MODULAR CONNECTOR FOR COAXIAL CABLES

BACKGROUND OF THE INVENTION

This invention relates to fittings for connecting coaxial cables together and to terminal devices, and relates to a novel and improved end connector for establishing and maintaining a mechanical and electrical connection through the use of a modular arrangement that incorporates a locking mechanism.

Coaxial cables are generally characterized by being made up of inner and outer concentric conductors (or center conductor and shield respectively) separated by a dielectric insulator and encased or covered by a protective outer jacket of rubber or rubber-like material. Numerous types of end connectors have been devised to effect a secure mechanical and electrical connection to the end of the coaxial cable and in such a way that the inner conductor and dielectric insulator extend through an inner sleeve of the connector while the outer conductor and jacket are inserted into an annular space between the inner sleeve and an outer concentric sleeve. The outer concentric sleeve is then crimped in a radial inward direction to securely clamp the end of the cable within the connector, and a fastener on the opposite end of the connector is then connected to the post or terminal. Representative of end connectors that have been devised for this purpose is that disclosed in U.S. Pat. No. 5,073,129 to Szegda which employs a combination of external ribs and internal serrations along the crimping sleeve in order to assure a reliable electrical connection and mechanical coupling between the cable and end connector. U.S. Pat. No. 4,400,050 to Hayward similarly employs a plurality of serrations along an internal surface of the crimping sleeve but which are specifically intended and designed to engage the outer conductor of the cable which is doubled over the external surface of the jacket and is concerned more with establishing firm gripping engagement with the end of the cable. Other patents of interest are U.S. Pat. No. 3,355,698 to Keller, U.S. Pat. No. 3,363,222 to Karol, U.S. Pat. No. 4,553,806 to Forney et al, U.S. Pat. No. 4,668,043 to Saba et al, U.S. Pat. No. 4,684,201 to Hutter, U.S. Pat. No. 4,755,152 to Elliot et al and U.S. Pat. No. 4,806,116 to Ackerman.

Prior art coaxial connectors include a female, screw-on type connector or a female, push-on type connector which can be connected to a male-type connector. More specifically, the screw-on type connector includes a female receptacle having an internally threaded bore configured to threadedly mate with external threads of a male coaxial connector connected to, for example, a cable-to-cable connector (commonly referred to as a barrel) or an electronic product or the terminal end of a coaxial cable. A problem with the screw-on type coaxial connector is that the relative inflexible coaxial cable makes the screw-on type connector difficult to align and threadedly mate together. The push-on type coaxial connector includes a female receptacle having an inside diameter configured to frictionally interact with the external threads of a male coaxial connector. While the push-on type coaxial connector is much easier to attach than the screw-on type coaxial connector, the push-on type coaxial connector can be separated from the male coaxial connector simply by pulling the coaxial cable or the female receptacle from the male coaxial connector. The push-on type connector also has a tendency to evolve a lower quality of electrical connection over time with the result that signals being transmitted over the coaxial cable are emitted into the atmosphere and become impaired.

U.S. Pat. No. 6,290,538 to Pocrass employs a plug and socket arrangement to effect connection between coaxial cables and from coaxial cables to terminal equipment. Pocrass connects the cables to the plug and socket using threaded connectors or by clamping the prepared cable in a housing such that electrical connectivity is established between cable and plug, or cable and socket. In the case of using threaded connectors, an additional connection is introduced into the electrical pathway to install the plug and/or socket connector. The alternate use of a clamping mechanism in the body of the connector plug and/or socket, as employed by Pocrass involves many additional parts making installation of the connector more difficult and time consuming to accomplish.

It is, therefore, an object of the present invention to overcome the above problems and others by providing a coaxial cable connector which can be easily connected directly to a cable, and that provides a removable connection between a pair of coaxial cables, or between a coaxial cable and a terminal device while sustaining electromagnetic shielding of a signal conveyed within the coaxial cable(s). Still other objectives of the present invention will become apparent to those of ordinary skill in the art upon reading and understanding the following detailed description.

SUMMARY OF INVENTION

Accordingly, I have invented a novel and improved modular connector assembly for positively splicing cables together, connecting cables at wall plates and connecting coaxial cables to terminal equipment.

The objective of the present invention is to provide a plug and socket assembly, each that attaches directly to the prepared end of a coaxial cable, a plug and socket assembly that employs a snap-fit, locking mechanism for maintaining the mechanical and electrical connection between the plug and socket assemblies when mated together.

It is another object of the present invention to provide for a plug assembly and socket assembly capable of effecting sealed engagement with one end of a coaxial cable and of being interchangeable for use with coaxial cables of different sizes and/or different impedances.

It is a further object of the present invention to provide for a novel and improved terminal connector assembly for coaxial cables utilizing the snap-fit, locking mechanism feature mentioned above; and wherein the fitting is adaptable for positive connection to different types of terminal equipment, wall plates and for splicing cables together.

In accordance with the present invention, a modular connector assembly has been devised for connecting an end of a coaxial cable to a plug and/or socket wherein the cable is a standard cable having radially inner and outer, generally cylindrical conductors separated by an annular dielectric, an outer tubular jacket of rubber or rubber-like material encasing the outer conductor and with a portion of both the inner and the outer conductor being exposed at the end of the cable.

The plug is comprised of radially inner and outer spaced conductors wherein the inner conductor is formed by the center conductor of the coaxial cable and extends through a conductive sleeve, this sleeve being sized for insertion of the outer conductor and jacket through one end of the connector between the inner and outer sleeves, a rib extending circumferentially around an inner wall surface portion of the outer sleeve adjacent to the one end of the outer sleeve, the rib engaging an external surface of the jacket only when the cable is fully inserted into the connector and the outer sleeve is deformed radially inwardly until the rib effects sealed engagement with the jacket, and a socket connector is complementary to the plug connector for connecting the cable to the socket. The conductive sleeve of the plug may be mounted into a dielectric casing which is formed so as to provide the retaining mechanism for the plug and to provide for physical mating with a complementary socket aperture. Alternatively, the plug may be a single piece formed of conductive material, or a single piece formed of a dielectric material with conductive material deposited on appropriate surfaces.

The socket is comprised of radially inner and outer spaced conductors wherein the inner conductor is formed by the center conductor of the coaxial cable and extends into the socket connector and is brought into engagement with conductive prongs in the body of the socket that are electrically connected with a second set of conductive prongs which are positioned for engagement with the center conductor of the plug connector when plug and socket are mated together. A conductive sleeve within the socket is sized for insertion of the outer conductor and jacket through one end of the connector between the inner and outer sleeves, a rib extending circumferentially around an inner wall surface portion of the outer sleeve adjacent to the one end of the outer sleeve, the rib engaging an external surface of the jacket only when the cable is fully inserted into the connector and the outer sleeve is deformed radially inwardly until the rib effects sealed engagement with the jacket, and a plug connector is complementary to the socket connector for connecting the cable to the plug. The conductive sleeve of the socket may be mounted into a dielectric casing which is formed so as to provide the complementary retaining mechanism and aperture for receiving the plug and to provide for physical mating with the complementary plug. The conductive sleeve of the socket is configured to move linearly through the socket body and employs a tensioning device to maintain adequate pressure between the conductive sleeves of the socket and plug when the plug is inserted into the socket.

Preferably, when the coaxial cable is received in the plug or socket the cable is rotatable with respect to the plug or socket body around an axis coaxial with the core of the coaxial cable.

In preferred and modified forms of the invention, one or more ribs or sealing rings are provided adjacent to the entrance end of the outer sleeve, each rib having an inner rounded surface deformable into a portion of the jacket until the jacket occupies a circumferentially extending space between each adjacent pair of the ribs, and the inner sleeve has external projections along an external wall surface of the inner sleeve adjacent to the one end. The outer sleeve when crimped with a crimping tool will uniformly reduce the diameter of the outer sleeve and cause the ribs to advance into uniform sealed engagement with the jacket. The use of this method, as shown in preferred and modified forms of the invention is not a novel aspect of the current invention, neither is it only method, consistent with the state of the art, for attaching the plug and/or socket to the end of a cable, and does not in any way limit the novel aspects of the current invention that may result from the use of other methods of attachment.

The terminal connector has a socket which serves to facilitate connection of the end connector to a terminal. The terminal connector employs a socket assembly suitable for insertion of a plug assembly, while further providing points of attachment to the inner and outer conductors of the socket assembly for connection to the electrical circuitry of the terminal.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
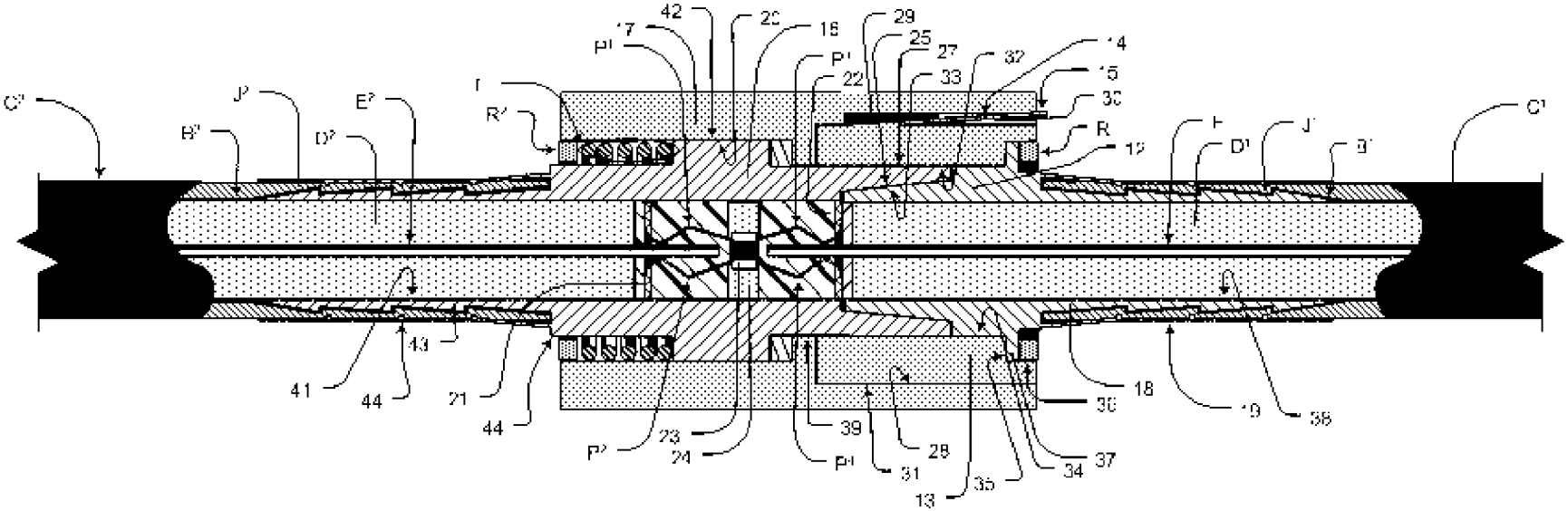
FIG. 1 is a longitudinal cross-sectional view illustrating one preferred form of the invention for interconnecting two cables with the parts fully assembled and connected together with the ends of two coaxial cables.
Figure 2:
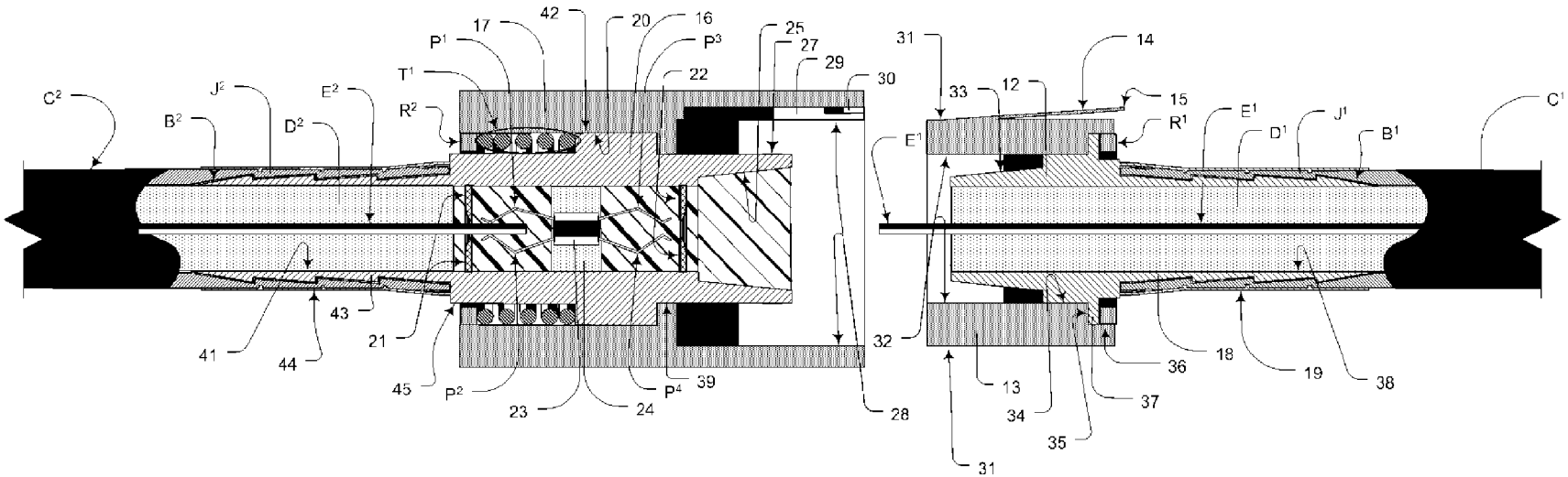
FIG. 2 is another longitudinal sectional view of the preferred form of invention shown in FIG. 1 but with the plug and socket portions of the assembly separated from one another.
Figure 3:
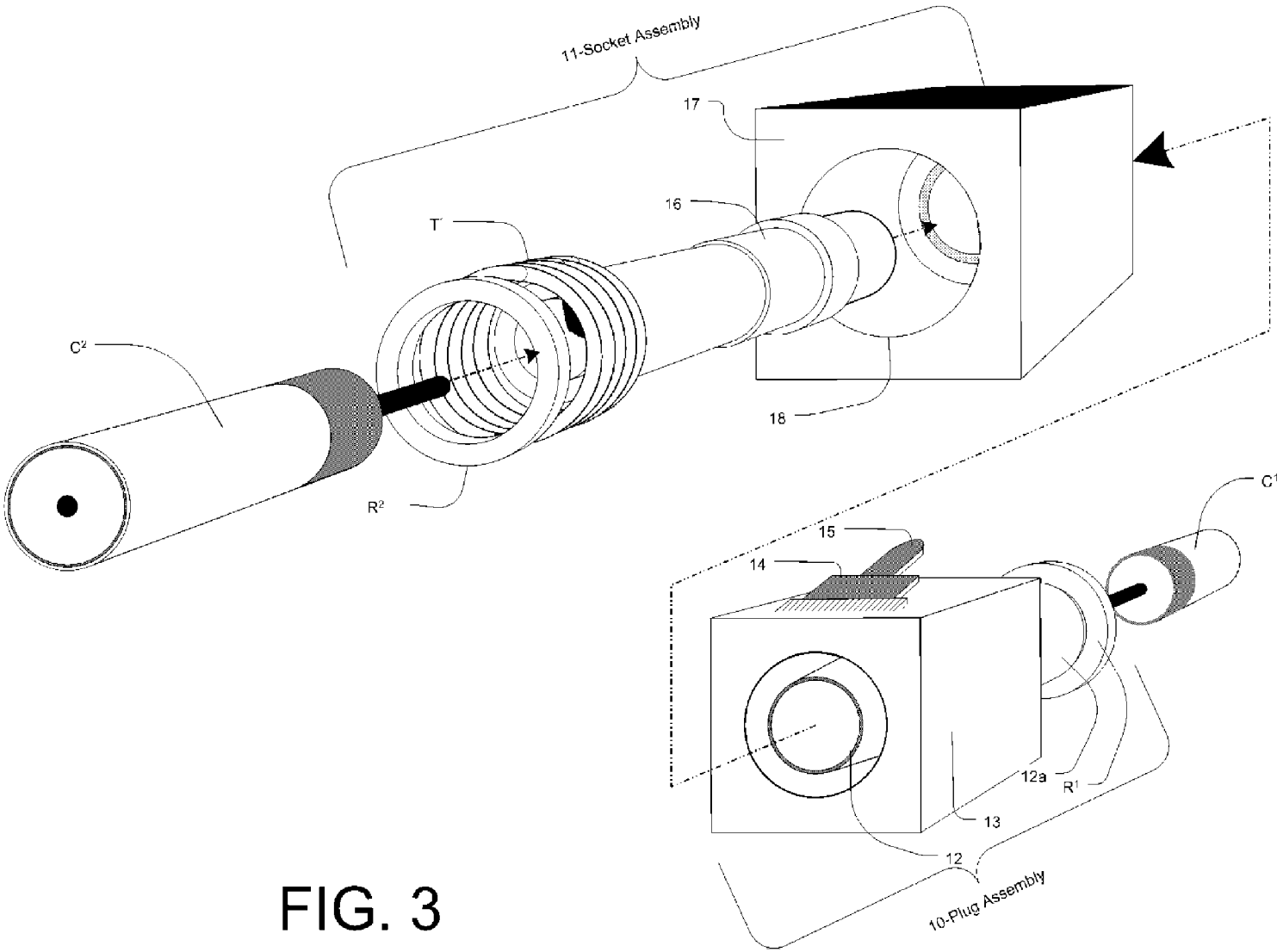
FIG. 3 is an exploded perspective view of the form of the invention shown in FIG. 1 and FIG. 2.
Figure 4:
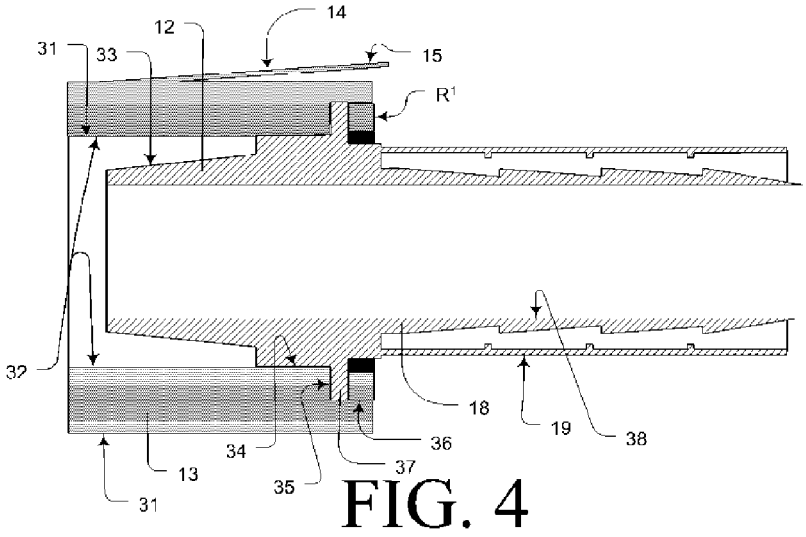
FIG. 4, is another longitudinal sectional of the plug assembly of the invention shown in FIG. 1, but here without a cable inserted.
Figure 4A:
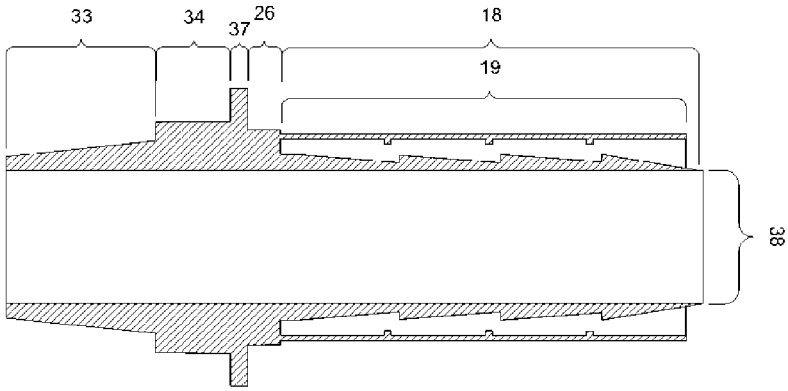
FIG. 4*a* is another longitudinal sectional view on the invention shown in FIG. 1, but showing only the conductive sleeve of the plug assembly.
Figure 4B:
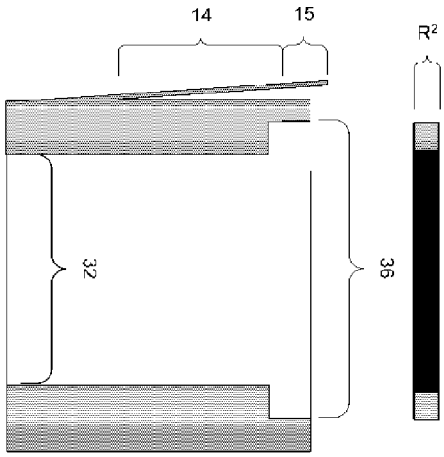
FIG. 4*b* is another longitudinal sectional view of the invention shown in FIG. 1, but showing only the body of the plug assembly.
Figure 5:
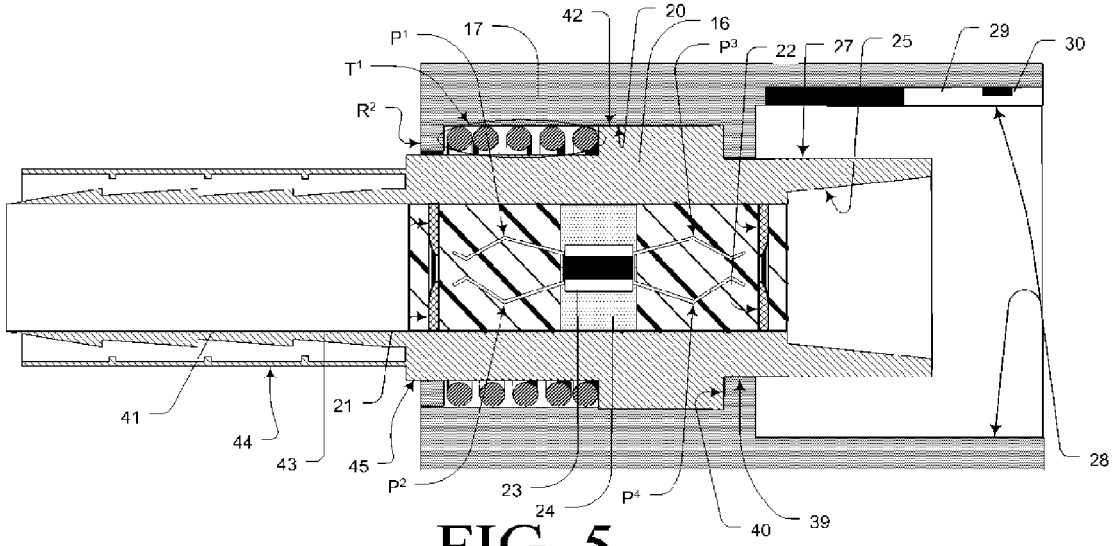
FIG. 5, is another longitudinal sectional of the socket assembly of the invention shown in FIG. 1, but here shown without a cable inserted.
Figure 5A:
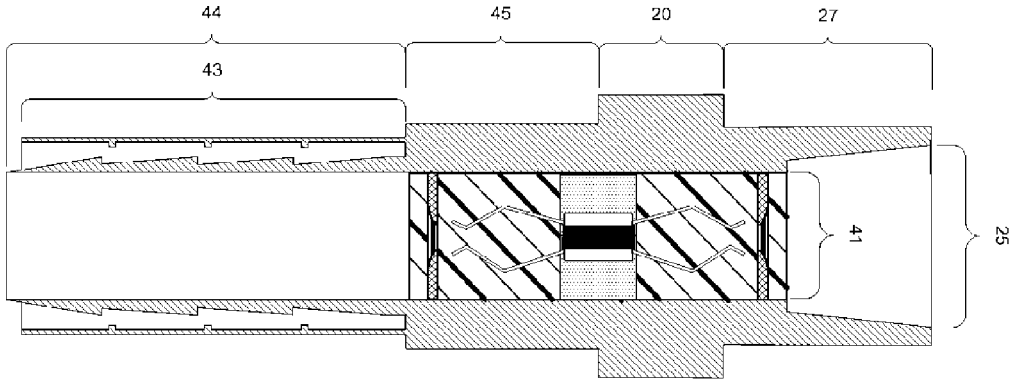
FIG. 5*a* is another longitudinal sectional view on the invention shown in FIG. 1, but showing only the conductive sleeve of the socket assembly.
Figure 5B:
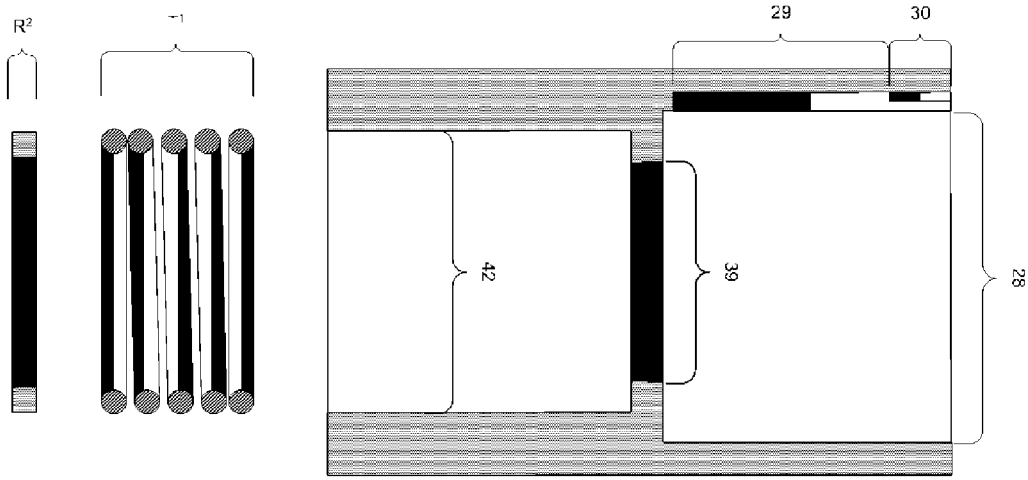
FIG. 5*b* is another longitudinal sectional view on the invention shown in FIG. 1, but here showing only the body of the socket assembly.
Figure 6:
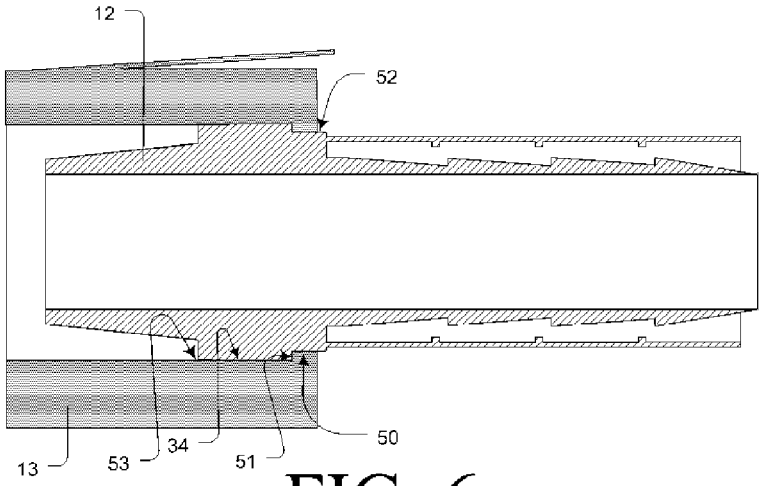
FIG. 6 is a longitudinal sectional view of an alternate form of the plug assembly and employs an alternate form for maintaining mechanical positioning and electrical connection when plug and socket are mated together, shown without a cable inserted.
Figure 6A:
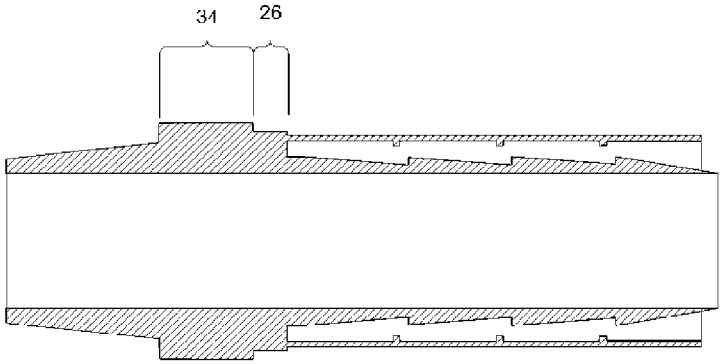
FIG. 6*a* is another longitudinal sectional view of the alternate form of the invention shown in FIG. 6, but showing only the conductive sleeve of the plug assembly.
Figure 6B:
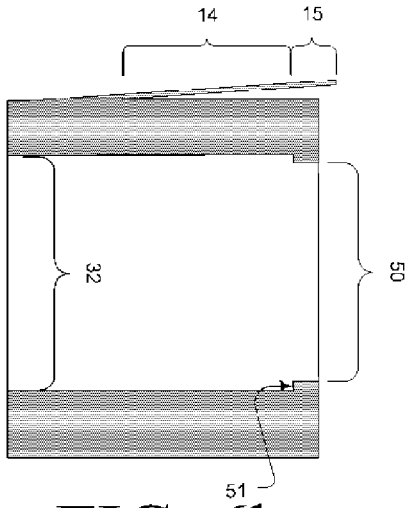
FIG. 6*b* is another longitudinal sectional view of the alternate form of the invention shown in FIG. 1, but here showing only the body of the plug assembly.
Figure 7:
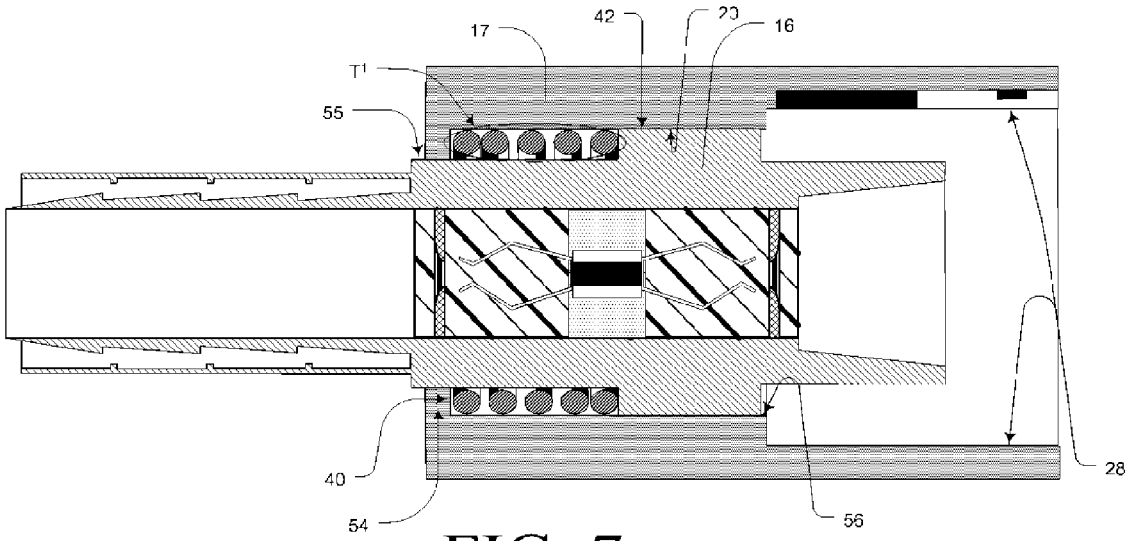
FIG. 7 is a longitudinal sectional view of an alternate form of the socket assembly and employs an alternate form for maintaining mechanical positioning and electrical connection when plug and socket are mated together, shown without a cable inserted.
Figure 7A:
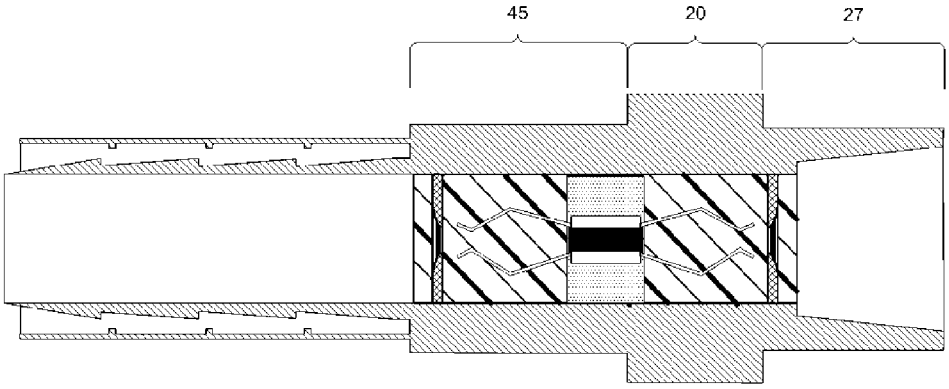
FIG. 7*a* is another longitudinal sectional view of the alternate form of the invention shown in FIG. 6, but showing only the conductive sleeve of the socket assembly.
Figure 7B:
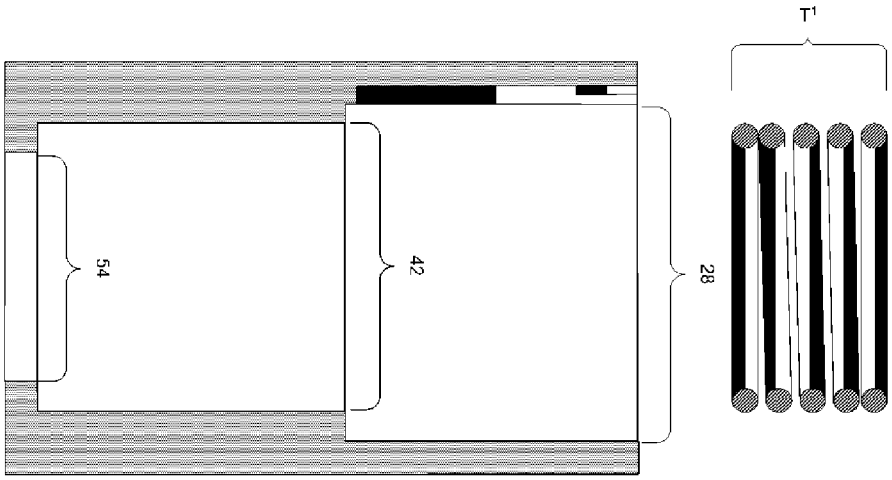
FIG. 7*b* is another longitudinal sectional view of the alternate form of the invention shown in FIG. 1, but here showing only the body of the socket assembly.

Referring in more detail to the drawings, there is shown by way of illustrative example in FIGS. 1, 2, 3, 4, 4*a*, 4*b*, 5, 5*a* and 5*b* a plug assembly 10 and socket assembly 11 for positively interconnecting conventional forms of coaxial cables $C^1$ and $C^2$. As a setting for the present invention, inner and outer sleeves, 18 and 19 of plug assembly 10, and 43 and 44 of socket assembly 11, are of a type employed in existing screw type and push type connectors, and form the components of said connectors that capture a coaxial cable in the connector. These are shown in preferred and modified forms of the invention as only one viable method of directly connecting the novel portions of the invention directly to a cable, which, by providing for direct connection to the plug assembly and/or socket assembly, is, in and of itself, a novel element of the current invention.

The plug assembly 10 is broadly comprised of a plug body 13, having a locking tab 14 with release tab 15, with bore 32 and counterbore 36 into which plug conductive sleeve 12 is inserted. Plug assembly 10 is further comprised of plug conductive sleeve 12 having a central bore 38, tapered cone 33, cylindrical element 34, flange 37, cylindrical element 26, inner sleeve 18 and outer sleeve 19. Plug conductive sleeve 12 is retained in plug body 13 by retaining ring $R^1$ that may be either a snap- or press-fit retaining ring of generally circular construction.

Plug body 13 has flat, external outer surfaces 31 that are complimentary to the flat, internal guiding surfaces 28 of socket body 17 providing mechanical alignment of plug to socket. When plug assembly 10 is inserted in to socket body 17, locking tab 14 is flexed downward to permit insertion, and when fully inserted into socket body 17, locking tab 14 flexes upward returning to its resting position, engaging socket locking cavity 29 such that plug assembly 10 remains in engagement with socket assembly 11 and cannot be withdrawn. Release tab 15 extends outward through socket body 17 through locking tab release slot 30 and provides the means of disengaging locking tab 14 from socket locking cavity 29 for un-mating of plug and socket assemblies. Such disengagement is accomplished by depressing release tab 15, which flexes locking tab 14 downward, disengaging it from socket locking cavity 29, thereby permitting withdrawal of plug assembly 10 from socket assembly 11. The plug mating cavity formed by bore 32 is configured to receive cylindrical element 27 of socket conductive sleeve 16.

Plug conductive sleeve 12 is formed with tapered conductive cone 33 that engages with tapered counterbore 25 of socket conductive sleeve 16 of socket assembly 11 when mated together. Tapered conductive cone 33 and tapered counterbore 25 when mated together provide a conductive path between plug and socket assemblies 10 and 11, providing continuity between the outer conductors of cables $C^1$ and $C^2$. Plug conductive sleeve 12 is further formed with cylindrical element 34 and flange element 37 for insertion into bore 32 and counterbore 36 of plug body 13 with flange 37 resting against shoulder 35 when fully inserted into plug body 13. Retaining ring $R^1$ is inserted into counterbore 36, retaining conductive sleeve 12 in plug body 13.

As shown in FIGS. 1, 2, 3, 4, 4*a*, 4*b*, 5, 5*a* and 5*b*, plug conductive sleeve 12 has an inner sleeve 18 extending rearward from cylindrical element 26 with reduced diameter and wall thickness in relation to cylindrical element 26, and an outer sleeve 19 also extending reward from cylindrical element 26. Inner sleeve 18 and outer sleeve 19 are not novel elements of plug assembly 10 and are only included to illustrate one method of directly capturing and retaining coaxial cable $C^1$ within plug assembly 10 and providing electrical connection between outer conductor $B^1$ of cable $C^1$ and conductive sleeve 12 of plug assembly 10.

In accordance with conventional practice, the coaxial cable $C^1$ is made up of an inner conductor $E^1$, a dielectric insulator $D^1$, outer braided conductor $B^1$ and dielectric jacket $J^1$, the latter being composed of a suitable rubber or rubber-like compound. The inner conductor $E^1$ is in the form of a pin which is exposed by removing a limited length of the dielectric insulator $D^1$, and a limited length of the conductor $B^1$ is peeled away from the insulator $D^1$ and doubled over the outer jacket $J^1$.

When cable $C^1$ is inserted into plug conductive sleeve 12, outer conductor $B^1$ is brought into contact with the outer surface of inner sleeve 18 providing electrical connectivity between cable $C^1$ and tapered conductive cone 33 through conductive sleeve 12. The exposed portion of dielectric $D^1$ extends through sleeve 18 to the inner end of plug conductive sleeve 12, with the exposed portion of inner conductor $E^1$ extending there from with sufficient length to through insulating guide 22 of socket assembly 11 and come into engagement with conductive prongs $P^3$ and $P^4$ of socket assembly 11. With cable $C^1$ fully inserted, outer sleeve 19 is compressed radially inward to effect sealed engagement between cable $C^1$ and conductive sleeve 12.

The socket assembly 11 is broadly comprised of a socket body 17, with locking cavity 29 with release tab slot 30, and with bore 39 and counterbore 42 into which socket conductive sleeve 16 is inserted. Socket assembly 11 is further comprised of conductive sleeve 16 having a central bore 41, plug engaging cylinder 27, tapered counterbore 25, cylindrical element 45, flange 20, inner sleeve 43 and outer sleeve 44. Within socket conductive sleeve 16 are located insulating guide rings 21 and 22, conductive prongs $P^1$, $P^2$, $P^3$ and $P^4$, conductive element 23 and potting material which forms dielectric support 24. Conductive sleeve 16 is retained in socket body 17 by tensioning element $T^1$ and retaining ring $R^2$. Retaining ring $R^2$ may be either a snap- or press-fit retaining ring of generally circular construction. Tensioning element $T^1$ keeps conductive sleeve 16 in a fully forward position when plug assembly 10 is not mated to socket assembly 11. When plug assembly 10 is inserted into socket assembly 11, tensioning element $T^1$ permits socket conductive sleeve to retract within socket body 17, and further serves to maintain physical alignment and electrical contact between socket conductive sleeve 16 and plug conductive sleeve 12 by applying pressure at the juncture formed by tapered cone 33 of plug conductive sleeve 12 and tapered counterbore 25 of socket conductive sleeve 16.

Socket body 17 has flat, internal surfaces 28 recessed into one end that are complimentary to the flat, external outer surfaces 31 of plug body 13, and serve to guide plug assembly 10 into a proper mating position with socket assembly 11. When socket assembly 11 receives plug assembly 10, socket locking cavity 29 receives locking tab 14 such that plug assembly 10 is held in engagement with socket assembly 11 and cannot be withdrawn. Locking tab release slot 30 provides a channel for release tab 15 to extend outward through socket body 17 providing the means of disengaging locking tab 14 from locking cavity 29. In the fully mated position, locking tab 14 maintains plug assembly 10 within socket assembly 11 against the force exerted by tensioning element $T^1$ through the junction between socket conductive sleeve 16 and plug conductive sleeve 12 which is formed by tapered counterbore 25 and tapered cone 33.

Socket conductive sleeve 16 is formed with plug engaging cylinder 27 that extends into the mating cavity of socket body 17, which cavity is formed by flat internal surfaces 28. Cylindrical element 27 is sized for insertion the receiving cavity of plug body 13 formed by bore 32 of plug body 13. Tapered counterbore 25 of engaging cylinder 27 engages with tapered conductive cone 33 of plug conductive sleeve 12 when plug and socket assemblies are mated together. Tapered counterbore 25 and tapered conductive cone 33 when mated together provide a conductive path between plug and socket assemblies 10 and 11, establishing electrical continuity of the outer conductors of cables $C^1$ and $C^2$. Socket conductive sleeve 16 is further formed with cylindrical element 45 and flange 20 for insertion into concentric bore 39 and counterbore 42 of socket body 13 with flange 37 resting against shoulder 40 when fully inserted into socket body 17. Tensioning element $T^1$ and retaining ring $R^1$ are inserted over cylindrical element 45 and into bore 36 thereby retaining socket conductive sleeve 16 in socket body 17 with tensioning element $T^1$ applying force upon socket conductive sleeve, positioning conductive sleeve 16 in fully forward in bore 42 with cylindrical element 45 resting against shoulder 40 when plug assembly 10 in not mated to socket assembly 11.

As shown in FIGS. 1, 2, 3, 4, 4*a*, 4*b*, 5, 5*a* and 5*b*, socket conductive sleeve 16 has an inner sleeve 43 extending rearward from cylindrical element 45 with reduced diameter and wall thickness in relation to cylindrical element 45, and an outer sleeve 44 also extending reward from cylindrical element 45. Inner sleeve 43 and outer sleeve 44 are not novel elements of socket plug assembly 11 and are only included to illustrate one method of capturing and retaining coaxial cable $C^2$ within socket assembly 11 and providing electrical connection between outer conductor $B^2$ of cable $C^2$ and conductive sleeve 16 of socket assembly 11.

In accordance with conventional practice, the coaxial cable $C^2$ is made up of an inner conductor $E^2$, a dielectric insulator $D^2$, outer braided conductor $B^2$ and dielectric jacket $J^2$, the latter being composed of a suitable rubber or rubber-like compound. The inner conductor $E^2$ is in the form of a pin which is exposed by removing a limited length of the dielectric insulator $D^2$, and a limited length of the conductor $B^2$ is peeled away from the insulator $D^2$ and doubled over the outer jacket $J^2$.

When cable $C^2$ is inserted into socket conductive sleeve 16, outer conductor $B^2$ is brought into contact with the outer surface of inner sleeve 43 providing electrical connectivity between cable $C^2$ and tapered counterbore 25 through conductive sleeve 16. The exposed portion of dielectric $D^2$ extends through inner sleeve 43 to a position short of that occupied by insulating guide 21 contained within bore 41 of conductive sleeve 16. The exposed portion of inner conductor $E^2$ extends there from with sufficient length to pass through insulating guide 21 and come into engagement with conductive prongs $P^1$ and $P^2$ contained within bore 41 of conductive sleeve 16. With cable $C^2$ fully inserted, outer sleeve 19 is compressed radially inward to effect sealed engagement between cable $C^2$ and conductive sleeve 16.

Within central bore 41 of conductive sleeve 16, prongs $P^1$ and $P^2$ are attached to one end of conductive element 23 with prongs $P^3$ and $P^4$ being attached to the opposing end of conductive element 23, and facing in the opposing direction, with conductive element 23 providing electrical continuity between respective prong pairs. When cable $C^2$ is inserted into socket assembly 11, the exposed portion of center conductor $E^2$ passes through insulating guide ring 21 and is brought into contact with prongs $P^1$ and $P^2$. When plug assembly 10 is mated to socket assembly 11, the exposed portion of center conductor $E^1$ through insulating guide 22 and is brought into contact with prongs $P^3$ and $P^4$. This arrangement provides the electrical connection between the center conductors of cable $C^1$ and cable $C^2$. Potting material forming dielectric support 24 maintains the assembled conductive elements $P^1$, $P^2$, $P^3$ and $P^4$, and conductive element 23 centrally within bore 41 of conductive sleeve 16.

In order to assemble the plug and socket assemblies (10 and 11 respectively) onto their respective cables ($C^1$ and $C^2$ respectively), each cable is prepared as earlier described and inserted into the inner and outer sleeves of the respective plug and socket assembly (18 and 19 for cable C1 and plug assembly 10; and 43 and 44 for cable C2 and socket assembly 11). Outer sleeves 19 and 44 are then compressed radially inward using a device such as a crimping tool to effect sealed engagement of each cable to its respective plug and socket assembly. Thereafter, the plug assembly is inserted in a tensioned snap-fit relation into socket assembly 11 with center conductor $E^1$ extending through insulating guide ring 22 and coming into contact with prongs $P^3$ and $P^4$, and with tapered cone 33 coming into contact with counterbore 25 to complete the electrical connection between cables $C^1$ and $C^2$. In this relation, an inner continuous conductive path is established between the conductor $E^1$, prongs $P^3$ and $P^4$, conductive element 23, prongs $P^1$ and $P^2$, and conductor $E^2$; and an outer conductive path is established between the braided conductor $B^1$ via conductive sleeve 12, tapered cone 33, tapered counterbore 25, conductive sleeve 16 and braided conductor $B^2$. The conductive paths as described are insulated from one another by the dielectric material of the cables ($D^1$ and $D^2$) and dielectric support 24.

DETAILED DESCRIPTION OF ALTERNATE PREFERRED FORM OF INVENTION

FIGS. 6, 6*a*, 6*b* and FIGS. 7, 7*a*, 7*b* illustrates another form of plug assembly 10 and socket assembly 11, respectively, wherein the manner of putting together each assembly is modified along with the location of retaining devices used. Since the mechanical and electrical elements employed in the preferred form of the invention that effect mechanical and electrical connection between the plug and socket assemblies remain unchanged in this modified form of the invention, the elements related to such mechanical and electrical connection are not discussed in this section and those elements are not called out in FIGS. 6, 6*a*, 6*b* or FIGS. 7, 7*a*, 7*b*, except as they relate to the modified form of assembly and retention.

In the modified form of plug assembly 10, conductive sleeve 12 is modified such that flange 37 is eliminated, and the length of cylindrical element 34 is extended to meet cylindrical element 26. In plug body 13, counterbore 36 is eliminated and is replaced with bore 50. Bore 32 becomes a counterbore that is extended rearward to meet bore 50 and form shoulder 51. Conductive sleeve 12 is inserted into plug body 13 through the mating cavity formed by counterbore 32, and is retained within the plug body by either, 1. friction, 2. a retaining snap-ring placed at location 52, or 3.*a* retaining ring (snap- or press-fit) placed at location 53. The surface formed on conductive element 12 by the juncture of cylindrical element 34 and cylindrical element 26 rests against shoulder 51 when plug components are assembled.

In the modified form of socket assembly 11, conductive sleeve 16 is modified such that the length of cylindrical element 45 is increased, with flange 20 retaining its length, but being moved into a more forward in position. In socket body 17, bore 39 is eliminated and is replaced with bore 54 located in a position at the rear of the socket body. The direction of counterbore 42 is reversed such that it opens directly into the mating chamber formed by guide surfaces 28, with the juncture of counterbore 42 and bore 54 forming shoulder 57. Conductive sleeve 16 is inserted, with tension element T1 placed around cylindrical element 45, into counter bore 42 of socket body 13 through the mating cavity formed by guide surfaces 28. Cylindrical element 45 extends through tensioning device T1 and bore 36, and is retained within the socket body by either, 1. a retaining snap-ring placed at location 55, or 2.a retaining ring (snap- or press-fit) placed at location 56.

The assembly of both plug and socket assemblies onto their respective cables, along with the mating and establishing of mechanical and electrical connection between plug and socket assemblies, remains as discussed in the preferred form of the invention and is therefore not herein repeated.

DETAILED DESCRIPTION OF SECOND ALTERNATE PREFERRRED FORM OF INVENTION

Figure 8:
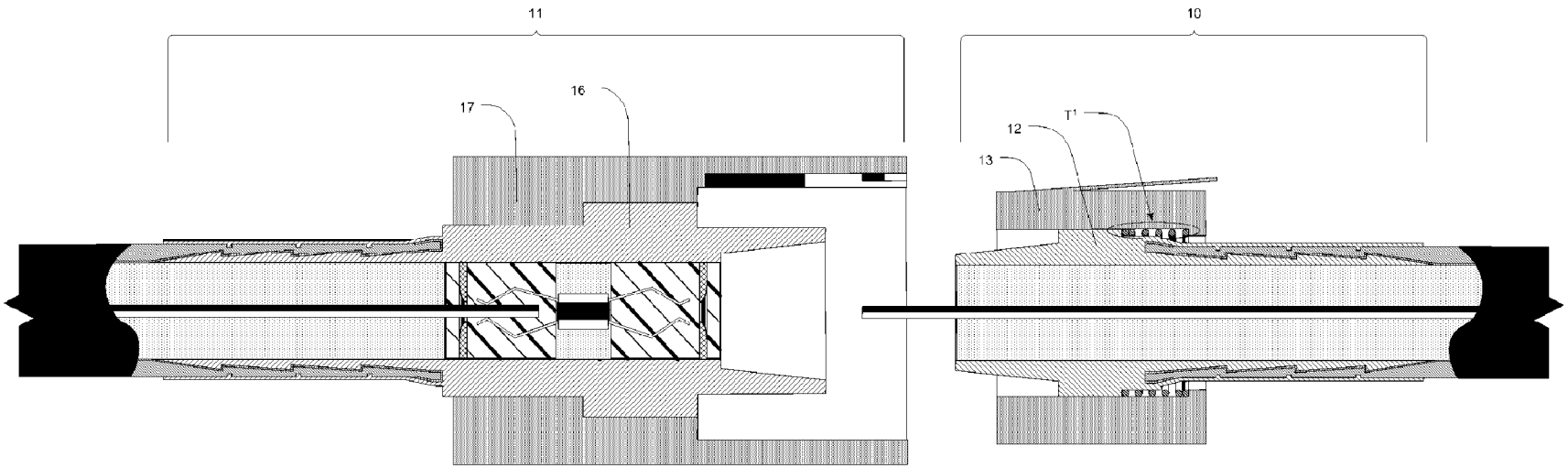
FIG. 8 is longitudinal sectional view of a second alternate form of the invention shown in FIG. 1, here shown with cables inserted, but without plug and socket mated together.
Figure 9:
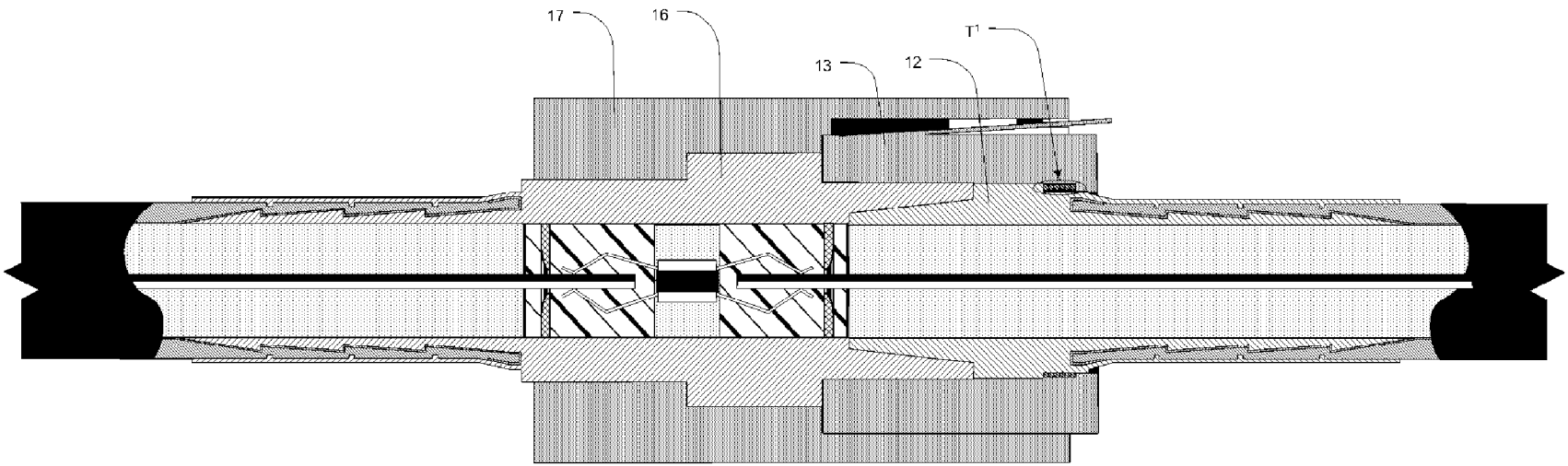
FIG. 9 is a longitudinal sectional view of the second alternate form of the invention shown in FIG. 8, here shown with cables inserted and with plug and socket mated together.

FIG. 8 and FIG. 9 illustrates a second alternate form of plug assembly 10 and socket assembly 11, wherein conductive sleeve 12 of plug assembly 10 is longitudinally moveable within plug body 13 and conductive sleeve 16 of socket assembly 11 is fixed within socket body 17.

In this form of the invention, tensioning device T1 is located within plug body 13 such that plug conductive sleeve 12 is held in a forward position when plug and socket are not mated together. When plug assembly 10 is inserted into socket assembly 11, seating of plug conductive sleeve 12 within socket conductive sleeve 16 occurs such that as plug assembly 10 is fully inserted within socket assembly 11, plug conductive sleeve 12 moves longitudinally against tensioning device T1. The locking mechanism described in the preferred form of the invention remains unchanged and holds plug and socket in engagement with one another against the pressure applied by tensioning device T1.

The assembly of both plug and socket assemblies onto their respective cables, along with the mating and establishing of mechanical and electrical connection between plug and socket assemblies, remains as discussed in the preferred form of the invention and is therefore not herein repeated.

DETAILED DESCRIPTION OF MODIFIED FORM OF INVENTION

Figure 10:
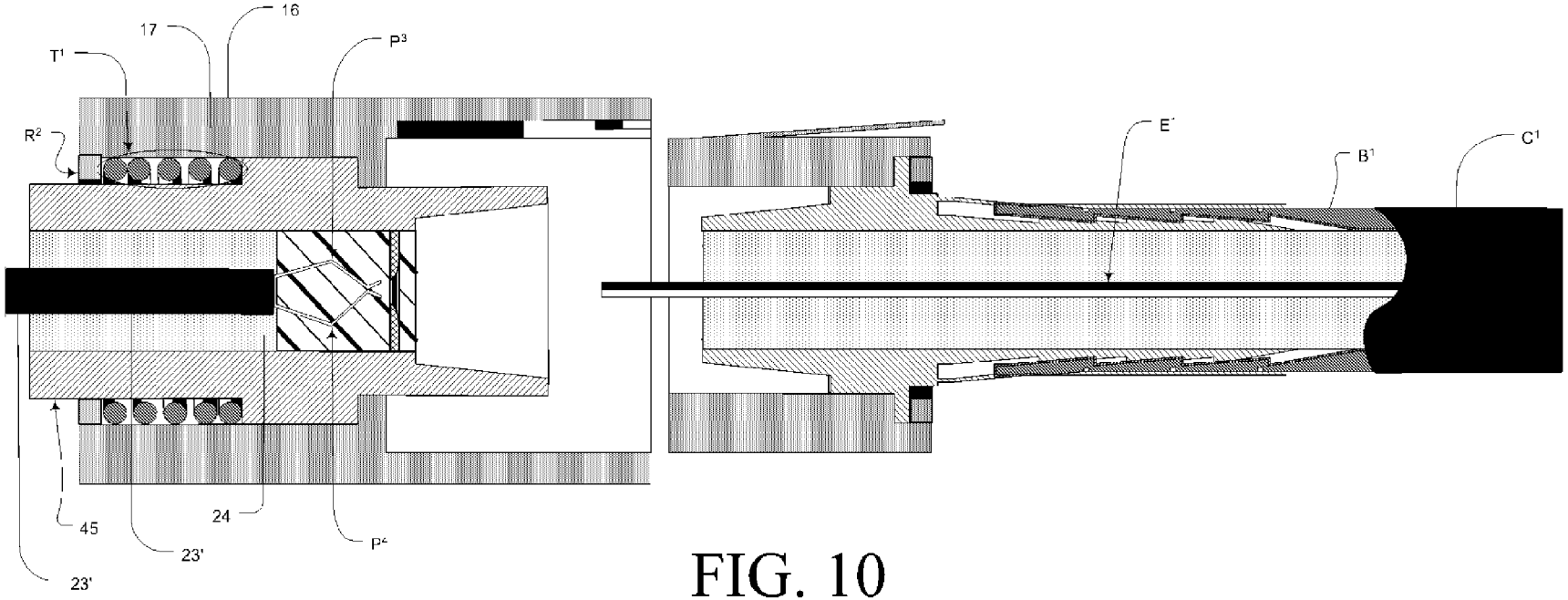
FIG. 10 is a longitudinal sectional view of a modified form of the invention for connecting a coaxial cable to terminal, or other equipment, wherein the socket is configured to provide points of access to the inner and outer conductors for connection to the electrical circuitry of the terminal equipment.

FIG. 10 illustrates another form of socket assembly 11 which is designed for use in connecting a cable to a terminal device or other electronic equipment in a novel and improved manner. For example, coaxial cable $C^1$ may extend from a wall plate or other equipment with a plug assembly of the type described in the preferred and alternate forms of the invention attached thereto, and conductive paths must be established between inner conductor $E^1$ and outer conductor $B^1$ of cable $C^1$ and presented within the terminal device or equipment for connection to the circuitry contained therein. To this end, a modified form of socket assembly 11 comprises a socket body 17 and socket conductive element 16 corresponding to the form shown in FIG. 8. In this modified form, cylindrical element 45 is lengthened such that it extends beyond socket body 17. In similar manner, conductive element 23 is extended in length such that it extends past the extended end of cylindrical element 45. Potting material forms a dielectric support 24 that insulates conductive element 23 from cylindrical element 45, and supports conductive element 23 within the central bore of socket conductive element 16 to the rearward most extension of cylindrical element 45. The extended portions of cylindrical element 45 and conductive element 23' are then available for electrical connection to the circuitry of a terminal device or other equipment.

With this modified form of socket assembly 11, cable C1, with plug assembly 10 attached thereto, may be connected to the terminal device, and electrical/mechanical connections established through socket assembly 11 to the circuitry of the terminal device or equipment. The plug assembly is inserted in a tensioned snap-fit relation into socket assembly 11 with center conductor $E^1$ extending through insulating guide ring 22 and coming into contact with prongs $P^3$ and $P^4$, and with tapered cone 33 coming into contact with counterbore 25 to complete the electrical connection between cable $C^1$, and the extended portions of cylindrical element 45 and conductive element 23 which are available for connection to the circuitry of the terminal. In this relation, an inner continuous conductive path is established between the conductor $E^1$, prongs $P^3$ and $P^4$, and extended conductive element 23; and an outer conductive path is established between the braided conductor $B^1$ via conductive sleeve 12, tapered cone 33, tapered counterbore 25, conductive sleeve 16 and the extended.

It is therefore to be understood that while preferred, modified and alternate forms of invention are herein set forth and described, various modifications and changes may be made in the construction and arrangement of parts as well as composition of materials without departing from the spirit and scope of the present invention as defined by the appended claims.

What is claimed is:

1. A modular connector assembly for connecting coaxial cable together wherein said cable has radially inner and outer conductors separated by an annular dielectric, a tubular jacket encasing said outer conductor and a portion of said outer conductor being exposed at the end of said cable, said assembly comprising:

(a) a plug connector having radially inner and outer spaced coaxial sleeves, said inner sleeve being sized for insertion of said inner conductor and said annular dielectric therein, said outer sleeve being sized for insertion of said conductor and said jacket through one end of said connector between said inner and outer sleeves;

(b) said plug connector having a body with at least one locking tab, at least one locking release tab, guide surfaces, a central bore and a central counterbore;

(c) said plug connector having a hollow generally cylindrical portion, a tapered cone at one end of said cylindrical portion and a conductor member extending concentrically within said cylindrical portion;

(d) said cylindrical portion of said plug connector forming the outer conductor of said plug connector;

(e) a socket connector having radially inner and outer spaced coaxial sleeves, said inner sleeve being sized for insertion of said inner conductor and said annular dielectric therein, said outer sleeve being sized for insertion of said conductor and said jacket through one end of said connector between said inner and outer sleeves;

(f) said socket connector having a body with guide surfaces, mating cavity, at least one locking cavity, at least one locking tab release slot, a central bore and a central counterbore;

(g) said socket connector having a hollow generally cylindrical portion, a tapered counterbore at one end of said cylindrical portion and a central conductive member consisting of spring contacts and conductive element placed concentrically within said cylindrical portion;

(h) said cylindrical portion of said socket connector forming the outer conductor of said socket connector; and (i) said outer conductors of said plug connector and said socket connector including complementary end portions for positively connecting said outer conductors positively.

2. A connector assembly according to claim 1, said plug assembly directly connecting to a coaxial cable and said socket assembly directly connecting to a coaxial cable.

3. A connector assembly according to claim 1, said plug connecting end portion and said socket connecting end portion having complementary mating cavities and guide surfaces.

4. A connector assembly according to claim 1, wherein a tensioning device is employed in either the plug assembly or the socket assembly, said tensioning device being employed to maintain electrical and mechanical connection between said plug assembly and socket assembly.

5. A connector assembly according to claim 1, wherein said plug assembly and socket assembly each employ a cylindrical conductive sleeve, wherein the conductive sleeve of the either the plug assembly or the socket assembly is movable longitudinally within its respective plug or socket body, and the complementary conductive sleeve is fixed within its respective plug or socket body.

6. A terminal connector assembly for connecting an end of a coaxial cable to a terminal wherein said cable has radially inner and outer conductors separated by an annular dielectric, a tubular jacket encasing said outer conductor and a portion of said outer conductor being exposed at the end of said cable, said assembly comprising:

(a) a plug connector having radially inner and outer spaced coaxial sleeves, said inner sleeve being sized for insertion of said inner conductor and said annular dielectric therein, said outer sleeve being sized for insertion of said conductor and said jacket through one end of said connector between said inner and outer sleeves;

(b) said plug connector having a body with at least one locking tab, at least one locking release tab, guide surfaces, a central bore and a central counterbore;

(c) said plug connector having a hollow generally cylindrical portion, a tapered cone at one end of said cylindrical portion and a conductor member extending concentrically within said cylindrical portion;

(d) said cylindrical portion of said plug connector forming the outer conductor of said plug connector;

(e) said socket connector having a body with guide surfaces, mating cavity, at least one locking cavity, at least one locking tab release slot, a central bore and a central counterbore;

(g) said socket connector having a hollow generally cylindrical portion, a tapered counterbore at one end of said cylindrical portion and a central conductive member consisting of spring contacts and conductive element placed concentrically within said cylindrical portion;

(h) said central conductive member extending through said socket body such that electrical connection may be made to said central conductor within a terminal device;

(i) said cylindrical portion of said socket connector forming the outer conductor of said socket connector;

(j) said outer conductor of said socket connector extending through said socket body such that electrical connection may be made to said central conductor within a terminal device, and (k) said outer conductors of said plug connector and said socket connector including complementary end portions for positively connecting said outer conductors positively.

7. A terminal connector according to claim 6 wherein said plug assembly and socket assembly each employ a cylindrical conductive sleeve, wherein the conductive sleeve of the either the plug assembly or the socket assembly is movable longitudinally within its respective plug or socket body, and the complementary conductive sleeve is fixed within its respective plug or socket body.

* * * * *